US007644750B2

(12) United States Patent
Schroth et al.

(10) Patent No.: US 7,644,750 B2
(45) **Date of Patent: *Jan. 12, 2010**

(54) METHOD OF CASTING COMPONENTS WITH INSERTS FOR NOISE REDUCTION

(75) Inventors: James G. Schroth, Troy, MI (US); Michael D. Hanna, West Bloomfield, MI (US); Richard H. Hammar, Utica, MI (US); Omar S. Dessouki, Beverly Hills, MI (US); Brent D. Lowe, Milford, MI (US); Mark T. Riefe, Brighton, MI (US); Jeremy W. Short, Berkley, MI (US); Mark W. Verbrugge, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 465 days.

This patent is subject to a terminal disclaimer.

(21) Appl. No.: 11/475,759

(22) Filed: Jun. 27, 2006

(65) Prior Publication Data

US 2007/0062664 A1 Mar. 22, 2007

Related U.S. Application Data

(60) Provisional application No. 60/718,945, filed on Sep. 20, 2005.

(51) Int. Cl.
*B22D 19/00* (2006.01)
*B22D 19/04* (2006.01)

(52) U.S. Cl. ..... 164/100; 164/98

(58) Field of Classification Search ..... 164/100, 164/98

See application file for complete search history.

(56) References Cited

U.S. PATENT DOCUMENTS 1,989,211 A 1/1935 Norton (Continued)

FOREIGN PATENT DOCUMENTS

CN 2005/10113784.X 10/2005

(Continued)

OTHER PUBLICATIONS

International Search Report dated Apr. 2, 2007 for PCT/US06/29687 filed Jul. 31, 2006 and relating to this application.

(Continued)

*Primary Examiner*—Kuang Lin
(74) *Attorney, Agent, or Firm*—Reising Ethington P.C.

(57) ABSTRACT

The invention provides a method for manufacturing a powertrain component enclosure member, including the steps of: (A) positioning at least one insert into a mold, wherein the insert is provided with a coating to prevent bonding between the insert and the casting material; and (B) casting a wall of the powertrain component enclosure member in the mold around the insert such that a major portion of the insert is substantially non-bonded with the casting material to provide a proper interfacial boundary with the casting material for damping.

10 Claims, 2 Drawing Sheets

U.S. PATENT DOCUMENTS

| | | | | |
|---|---|---|---|---|
| 2,603,316 | A | 7/1952 | Pierce | |
| 3,085,391 | A | 4/1963 | Hatfield et al | |
| 3,147,828 | A | 9/1964 | Hunsaker | |
| 3,292,746 | A | 12/1966 | Robinette | 188/218 |
| 3,378,115 | A | 4/1968 | Stephens, III | |
| 3,425,523 | A | 2/1969 | Robinette | 188/218 |
| 3,509,973 | A | 5/1970 | Kimata | |
| 3,575,270 | A | 4/1971 | Reinbek et al. | |
| 3,774,472 | A | 11/1973 | Mitchell | |
| 3,841,448 | A | 10/1974 | Norton, Jr. | |
| 3,975,894 | A | 8/1976 | Suzuki | |
| 4,049,085 | A | 9/1977 | Blunier | |
| 4,072,219 | A | 2/1978 | Hahm et al. | |
| 4,250,950 | A | 2/1981 | Buxmann et al. | |
| 4,379,501 | A | 4/1983 | Hagiwara et al. | |
| 4,475,634 | A | 10/1984 | Flaim et al. | |
| 4,523,666 | A | 6/1985 | Murray | 188/218 |
| 4,905,299 | A | 2/1990 | Ferraiuolo et al. | |
| 5,004,078 | A | 4/1991 | Oono et al. | |
| 5,025,547 | A | 6/1991 | Sheu et al. | |
| 5,083,643 | A | 1/1992 | Hummel et al. | |
| 5,115,891 | A | 5/1992 | Raitzer et al. | |
| 5,139,117 | A | 8/1992 | Melinat | 188/264 |
| 5,143,184 | A | 9/1992 | Snyder et al. | 188/218 |
| 5,183,632 | A | 2/1993 | Kluchi et al. | |
| 5,259,486 | A | 11/1993 | Deane | |
| 5,310,025 | A | 5/1994 | Anderson | |
| 5,416,962 | A | 5/1995 | Passarella | 29/173 |
| 5,417,313 | A | 5/1995 | Matsuzaki et al. | 188/264 |
| 5,509,510 | A | 4/1996 | Ihm | |
| 5,530,213 | A | 6/1996 | Hartsock et al. | |
| 5,582,231 | A | 12/1996 | Siak et al. | |
| 5,620,042 | A | 4/1997 | Ihm | |
| 5,660,251 | A | 8/1997 | Nishizawa et al. | |
| 5,789,066 | A | 8/1998 | DeMare et al. | |
| 5,819,882 | A | 10/1998 | Reynolds et al. | |
| 5,855,257 | A | 1/1999 | Wickert et al. | 188/218 |
| 5,862,892 | A | 1/1999 | Conley | |
| 5,878,843 | A | 3/1999 | Saum | 188/218 |
| 5,927,447 | A | 7/1999 | Dickerson | |
| 6,047,794 | A | 4/2000 | Nishizawa | |
| 6,073,735 | A | 6/2000 | Botsch et al. | |
| 6,206,150 | B1 | 3/2001 | Hill | |
| 6,216,827 | B1 | 4/2001 | Ichiba et al. | |
| 6,223,866 | B1 | 5/2001 | Giacomazza | |
| 6,241,055 | B1 | 6/2001 | Daudi | |
| 6,241,056 | B1 | 6/2001 | Cullen et al. | |
| 6,283,258 | B1 | 9/2001 | Chen et al. | |
| 6,302,246 | B1 | 10/2001 | Naumann | 188/218 XL |
| 6,357,557 | B1 | 3/2002 | DiPonio | |
| 6,405,839 | B1 | 6/2002 | Ballinger et al. | |
| 6,465,110 | B1 | 10/2002 | Boss et al. | |
| 6,481,545 | B1 | 11/2002 | Yano et al. | |
| 6,505,716 | B1 | 1/2003 | Daudi et al. | 188/250 |
| 6,507,716 | B2 | 1/2003 | Nomura et al. | 399/80 |
| 6,543,518 | B1 | 4/2003 | Bend et al. | |
| 6,799,664 | B1 | 10/2004 | Connolly | |
| 6,880,681 | B2 | 4/2005 | Koizumi et al. | |
| 6,890,218 | B2 | 5/2005 | Patwardhan et al. | |
| 6,899,158 | B2 | 5/2005 | Matuura et al. | |
| 6,932,917 | B2 | 8/2005 | Golden et al. | |
| 7,066,235 | B2 | 6/2006 | Huang | |
| 2002/0084156 | A1 | 7/2002 | Ballinger et al. | |
| 2002/0104721 | A1 | 8/2002 | Schaus et al. | |
| 2003/0037999 | A1 | 2/2003 | Tanaka et al. | |
| 2003/0127297 | A1 | 7/2003 | Smith et al. | |
| 2003/0141154 | A1 | 7/2003 | Rancourt et al. | 188/218 |
| 2003/0213658 | A1 | 11/2003 | Baba | |
| 2004/0031581 | A1 | 2/2004 | Herreid et al. | |
| 2004/0045692 | A1 | 3/2004 | Redemske | |
| 2004/0074712 | A1 | 4/2004 | Quaglia et al. | |
| 2004/0084260 | A1 | 5/2004 | Hoyte et al. | |
| 2004/0242363 | A1 | 12/2004 | Kohno et al. | |
| 2005/0011628 | A1 | 1/2005 | Frait et al. | 164/132 |
| 2005/0150222 | A1 | 7/2005 | Kalish et al. | |
| 2005/0183909 | A1 | 8/2005 | Rau, III et al. | 188/218 XL |
| 2005/0193976 | A1 | 9/2005 | Suzuki et al. | |
| 2006/0076200 | A1 | 4/2006 | Dessouki et al. | 188/218 |
| 2006/0243547 | A1 | 11/2006 | Keller | |
| 2007/0142149 | A1 | 6/2007 | Kleber | |

FOREIGN PATENT DOCUMENTS

| | | |
|---|---|---|
| DE | 24 46 938 | 4/1976 |
| DE | 25 37 038 | 3/1977 |
| DE | 199 48 009 | 3/2001 |
| DE | 101 41 698 | 3/2003 |
| DE | 102005048258.9 | 10/2005 |
| EP | 0 205 713 | 12/1986 |
| GB | 1230 274 | 4/1971 |
| GB | 2 328 952 | 3/1999 |
| JP | 57154533 | 9/1982 |
| WO | WO 98/23877 | 6/1998 |
| WO | WO 01/36836 | 5/2001 |

OTHER PUBLICATIONS

Z. Wu, C. Richter, L. Menon, A Study of Anodization Process During Pore Formation in Nanoporous Alumina Templates, Journal of the Electrochemical Society, vol. 154, 2007.

W.-J. Lee, M. Alhoshan, W.H. Smyrl, Titanium Dioxide Nanotube Arrays Fabricated by Anodizing Processes, Journal of the Electrochemical Society, vol. 153, 2006, pp. B499-B505.

I.V. Sieber, P. Schmuki, Porous Tantalum Oxide Prepared by Electrochemical Anodic Oxidation, Journal of the Electrochemical Society, vol. 152, 2005, pp. C639-C644.

H. Tanaka, A. Shimada, A. Kinoshita, In situ Measurement of the Diameter of Nanopores in Silicon During Anodization in Hydrofluoric Acid Solution, Journal of the Electrochemic.

L.G. Hector, Jr., S. Sheu, Focused Energy Beam Work Roll Surface Texturing Science and Technology, Journal of Materials Processing & Manufacturing Science, vol. 2, Jul. 1993.

P.N. Anyalebechi, Ungrooved Mold Surface Topography Effects on Cast Subsurface Microstructure, Materials Processing Fundamentals, TMS 2007, pp. 49-62.

F. Yigit, Critical Wavelengths for Gap Nucleation in Solidification—Part 1: Theoretical Methodology, Journal of Applied Mechanics, vol. 67, Mar. 2000, pp. 66-76.

P.N. Anyalebechi, Undulatory Solid Shell Growth of Aluminum Alloy 3003 as a Function of the Wavelength of a Grooved Mold Surface Topography, TMS 2007, pp. 31-47.

Dessouki et al., U.S. Appl. No. 10/961,813, Coulumb friction damped disc brake rotors, filed Oct. 8, 2004.

Hanna et al., U.S. Appl. No. 11/475,756, Bi-metal disc brake rotor and method of manufacturing, filed Jun. 27, 2006.

Schroth et al., U.S. Appl. No. 12/025,967, Damped products and methods of making and using the same, filed Feb. 5, 2008.

Hanna et al., U.S. Appl. No. 11/440,916, Bi-metal disc brake rotor and method of manufacture, filed May 25, 2006.

Hanna et al., U.S. Appl. No. 11/554,234, Coulomb damped disc brake rotor and method of manufacturing, filed Oct. 30, 2006.

Walker et al., U.S. Appl. No. 11/926,798, Inserts with holes for damped products and methods of making and using the same, filed Oct. 29, 2007.

Hanna et al., U.S. Appl. No. 11/832,401, Damped product with insert and method of making the same, filed Aug. 1, 2007.

Kleber, et al., U.S. Appl. No. 11/848,732, Cast-in-place torsion joint, filed Aug. 31, 2007.

Hanna et al., U.S. Appl. No. 11/780,679, Method of manufacturing a damped part, filed Jul. 20, 2007.

Aase et al., U.S. Appl. No. 11/969,259, Method of forming casting with frictional damping insert, filed Jan. 4, 2008.

Hanna et al., U.S. Appl. No. 12/165,729, Method for securing an insert in the manufacture of a damped part, filed Jul. 1, 2008.

Hanna et al., U.S. Appl. No. 12/165,731, Product with metallic foam and method of manufacturing the same, filed Jul. 1, 2008.
Agarwal et al., U.S. Appl. No. 11/860,049, Insert with tabs and damped products and methods of making the same, filed Sep. 24, 2007.
Hanna et al., U.S. Appl. No. 12/174,163, Damped part, filed Jul. 16, 2008.
Hanna et al., U.S. Appl. No. 12/174,223, Method of casting damped part with insert, filed Jul. 16, 2008.
Hanna et al., U.S. Appl. No. 12/183,180, Casting noise-damped, vented brake rotors with embedded inserts, filed Jul. 31, 2008.
Hanna et al., U.S. Appl. No. 12/183,104, Low mass multi-piece sound damped article, filed Jul. 31, 2008.
Golden et al., U.S. Appl. No. 12/105,411, Insert with filler to dampen vibrating components, filed Apr. 18, 2008.
Hanna et al., U.S. Appl. No. 11/440,893, Rotor assembly and method, filed May 25, 2006.
Carter, U.S. Appl. No. 11/680,179, Damped automotive components with cast in place inserts and method of making the same, filed Feb. 28, 2007.
Ulicny et al., U.S. Appl. No. 12/105,438, Filler material to dampen vibrating components, filed Apr. 18, 2008.
Hanna et al., U.S. Appl. No. 12/272,164, Surface configurations for damping inserts, filed Nov. 17, 2008.
Hanna et al., U.S. Appl. No. 12/145,169, Damped product with an insert having a layer including graphite thereon and methods of making and using the same, filed Jun. 24, 2008.
Lowe et al., U.S. Appl. No. 12/174,320, Damped part with insert, filed Jul. 16, 2008.
Xia, U.S. Appl. No. 12/858,596, Lightweight brake rotor and components with composite materials, filed Sep. 20, 2007.
Dessouki et al., U.S. Appl. No. 12/178,872, Friction damped brake drum, filed Jul. 24, 2008.
Sachdev et al., U.S. Appl. No. 11/832,356, Friction welding method and products made using the same, filed Aug. 1, 2007.
Disc Brake Squeal: Diagnosis and Prevention, SAE publication 903NVC-224, O.Dessouki, G. Drake, B.Lowe, and W.K.Chang. 7 pages, dated 2002.

METHOD OF CASTING COMPONENTS WITH INSERTS FOR NOISE REDUCTION

CROSS-REFERENCE TO RELATED APPLICATION

This application claims the benefit of U.S. Provisional Application No. 60/718,945, filed Sep. 20, 2005.

TECHNICAL FIELD

The present invention relates to a method and apparatus for damping vehicle noise by casting steel inserts into powertrain housing components to provide noise-damping interfaces within the cast components.

BACKGROUND OF THE INVENTION

Vehicle engine noise transmitted to the passenger compartment of the vehicle contributes to rider discomfort. In an effort to reduce the transmission of noise from the engine to the passenger compartment, a variety of techniques have been employed, including the use of polymer coatings on engine parts, sound absorbing barriers, and laminated panels having viscoelastic layers. Other noise reducing efforts have included the use of noise reducing engine mount designs, including active engine mounts that employ magnetorheological fluid actuators. While existing noise reducing efforts may have a positive effect on reducing the transmission of noise to the passenger compartment, there still remains a need in the art to address the problem associated with the source of the noise. Accordingly, there is a need in the art for alternative ways to dampen vehicle noise.

U.S. patent application Ser. No. 10/961,813, filed Oct. 8, 2004, commonly assigned with the present application, teaches Coulomb friction damped disc brake rotor configurations having an insert within the rotor to provide improved damping. Also, U.S. patent application Ser. No. 11/062,101, filed Feb. 18, 2005, commonly assigned with the present application, teaches damping elements positioned within a void of a vehicle powertrain component for noise damping. Further, U.S. Provisional Application Ser. No. 60/717,310, filed Sep. 15, 2005, entitled "Bi-Metal Disc Brake Rotor and Method of Manufacturing", commonly assigned with the present application, teaches a method for manufacturing a friction damped disc brake rotor, including the steps of: (A) positioning at least one insert into a mold, wherein the insert has a body with tabs extending therefrom to hold the insert in a desired position within the mold; and (B) casting a rotor cheek of the disc brake rotor in the mold around the insert such that a portion of each tab is bonded with the rotor cheek and the body is substantially non-bonded with the rotor cheek so that the body provides a proper interfacial boundary with the cheek for damping while the bonding of the tabs with the rotor cheek prevents corrosion-causing exterior elements from reaching the interfacial boundary.

SUMMARY OF THE INVENTION

The invention provides a method for manufacturing a powertrain component enclosure member, including the steps of: (A) positioning at least one insert into a mold, wherein the insert is provided with a coating to prevent bonding between the insert and the casting material; and (B) casting a wall of the powertrain component enclosure member in the mold around the insert such that a major portion of the insert is substantially non-bonded with the casting material to provide a proper interfacial boundary with the casting material for damping noise.

The insert may include tabs which support the insert in a suspended position within a mold for casting. The insert is provided with a coating and the coating is washed off of the tabs prior to casting to achieve at least partial bonding of the tabs with the cast wall of the powertrain component enclosure member. Alternatively, the tabs may be coated with graphite or other suitable agent to achieve the bonding with the wall.

With a portion of each tab bonded with the wall, corrosion-causing exterior elements are prevented from reaching the interfacial boundary.

The insert may be a flat or curved laminar component, or it may be a component having a large surface area, such as a bundle of wires, etc., which would provide greater surface area for interfacial boundaries, thus increasing damping.

The invention has been demonstrated for grey iron cast around a steel insert, however, a similar effect should be obtained if an insert is cast into aluminum or magnesium alloys. Like the cast iron/steel insert arrangement, adhesion of the cast structure to the insert must be avoided by use of a barrier coating, or by selection of an insert material that is not "wet" (i.e. melted to cause bonding) by the casting material. An aluminum insert could be used instead of steel, as long as it doesn't dissolve and has a higher melting point than the cast metal.

Also, the invention may be applicable to products other than powertrain components, such as steering knuckles, control arms, cast cradles, cast instrument panel beams, or any structural or closure casting. Also, the invention may benefit traction drive motors for hybrid electric and pure electric propulsion systems, as well as containment/housings for high voltage contactors. Other potential applications include any structure which produces audible and objectionable noise in service, such as manufacturing machines, railroad equipment, passenger planes, etc. However, the invention seems particularly well suited for powertrain components which house or enclose one or more rotating, noise-generating components of a vehicle powertrain.

These and additional features and advantages of the present invention will become clearer from the following detailed description of the preferred embodiments.

DESCRIPTION OF THE PREFERRED EMBODIMENTS

The invention provides a method for manufacturing a powertrain component enclosure member, including the steps of: (A) positioning at least one insert into a mold, wherein the insert is provided with a coating to prevent bonding between the insert and the casting material; and (B) casting a wall of the powertrain component enclosure member in the mold around the insert such that a major portion of the insert is substantially non-bonded with the casting material to provide a proper interfacial boundary with the casting material for damping.

Preferably, the insert is supported within the mold cavity by a non-coated tab, as described in the above-referenced U.S. Provisional Application Ser. No. 60/717,310, filed Sep. 15, 2005, entitled "Bi-Metal Disc Brake Rotor and Method of Manufacturing", commonly assigned with the present application, teaches a method for manufacturing a friction damped disc brake rotor, including the steps of: (A) positioning at least one insert into a mold, wherein the insert has a body with tabs extending therefrom to hold the insert in a desired position within the mold; and (B) casting a rotor cheek of the disc brake rotor in the mold around the insert such that a portion of each tab is bonded with the rotor cheek and the body is substantially non-bonded with the rotor cheek so that the body provides a proper interfacial boundary with the cheek for damping while the bonding of the tabs with the rotor cheek prevents corrosion-causing exterior elements from reaching the interfacial boundary. Further details regarding the coating and process are found in U.S. Provisional Application Ser. No. 60/718,579, filed Sep. 19, 2005, entitled "Bi-Metal Disc Brake Rotor and Method of Manufacturing", commonly assigned with the present application.

Figure 1:
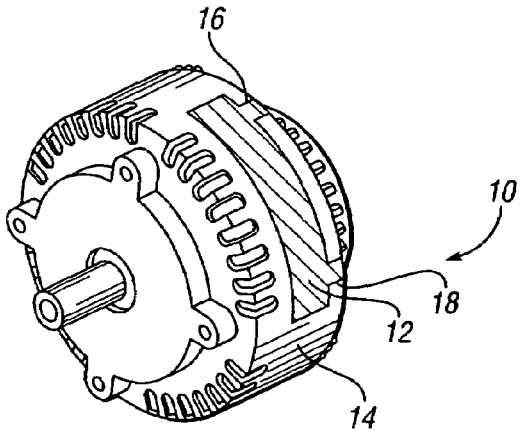
FIG. 1 shows a schematic perspective view of an electric drive motor housing having a cast insert in accordance with the invention.

Referring to FIG. 1, a schematic perspective view of an electric drive motor housing 10 is shown having an insert 12 which is cast into the peripheral wall 14 of the electric drive motor housing in accordance with the invention. The insert 12 is preferably coated prior to casting to provide proper boundary interface between the insert 12 and the wall 14 to prevent "wetting" and bonding of the insert 12 with the wall 14. The insert 12 may be provided with peripheral tabs 16, 18 to support the insert in a suspended position within a mold cavity for casting. The tabs are preferably non-coated to enhance wetting and bonding between the tabs 16, 18 and the wall 14 to prevent unwanted corrosion causing elements from reaching the interfacial boundary between the insert 12 and the wall 14.

The insert 12 is a pre-manufactured steel or aluminum component having a coating on opposing surfaces thereof. These coated surfaced 36, 38 do not bond with the cast metal in the casting operation. The lack of "wetting" or affinity along these coated surfaces produces the desired interfacial boundary for damping. However, again, the tabs 16, 18 are configured in a manner to bond with the cast metal of the wall 14. This bonding may be achieved by first coating the tabs with the same material which forms the coated surfaces of the insert and then cleaning the coating off the tabs to locally remove the coating to allow the tabs to be micro-welded to the cast iron (or aluminum or magnesium alloy) to effectively seal the rest of the insert/iron interface from intrusion by water or other elements from the exterior of the casting. Alternatively, a graphite or other suitable coating may be applied to the tabs to enhance bonding with the cast metal. So called "wetting" of the tab edges can also be accomplished by masking the tab prior to application of the coating. The insert may comprise any material having a melting point higher than that of cast alloy that would not be dissolved during the casting process.

Tabs are not shown in other embodiments, but it is expected that some variation of the tabs 16, 18 would be included with each design.

Figure 2:
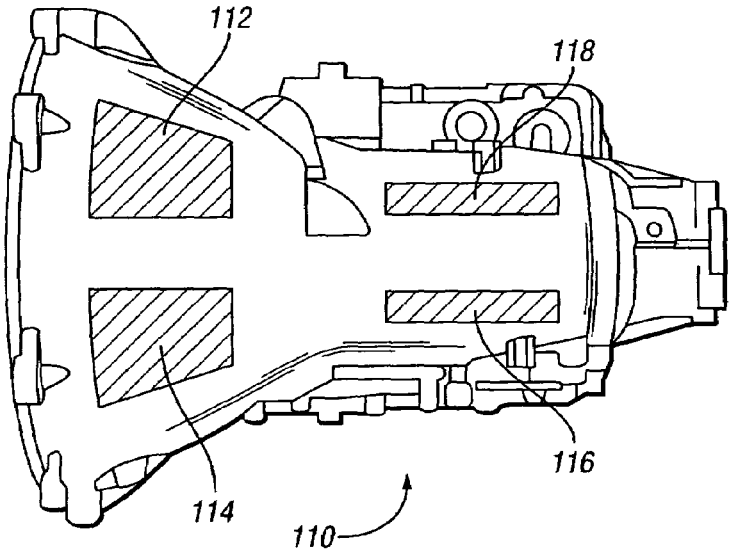
FIG. 2 shows a schematic perspective view of a transmission housing having cast inserts in accordance with the invention.

FIG. 2 shows a schematic perspective view of a transmission housing 110 having inserts 112, 114, 116, 118 cast-in in accordance with the invention.

Figure 3:
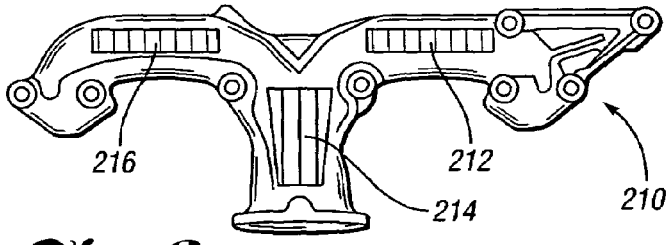
FIG. 3 shows a schematic perspective view of an exhaust manifold having cast inserts in accordance with the invention.

FIG. 3 shows a schematic perspective view of an exhaust manifold 210 having inserts 212, 214, 216 cast in accordance with the invention. The inserts 212, 216 are curved, and the insert 214 partially conical.

Figure 4:
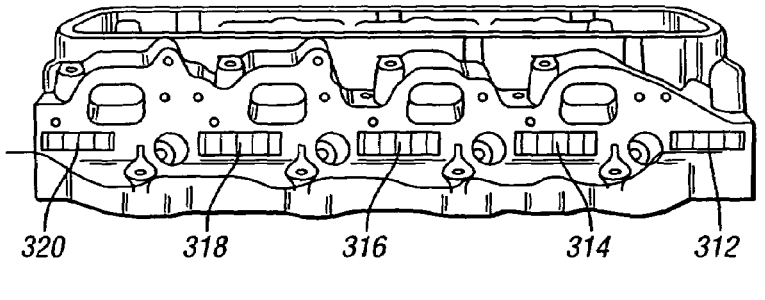
FIG. 4 shows a schematic perspective view of a cylinder head having cast inserts in accordance with the invention.

FIG. 4 shows a schematic perspective view of a cylinder head 310 having inserts 312, 314, 316, 318, 320 cast-in in accordance with the invention.

Figure 5:
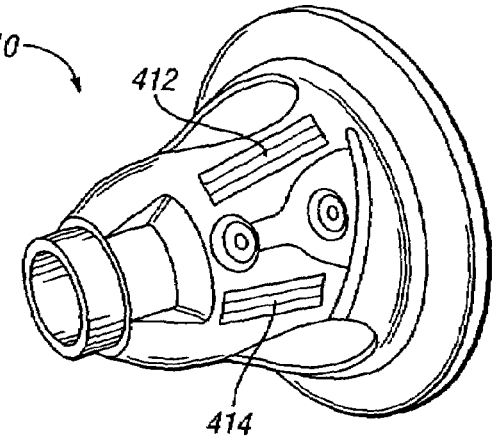
FIG. 5 shows a schematic perspective view of a differential case having cast inserts in accordance with the invention.

FIG. 5 shows a schematic perspective view of a differential case 410 having inserts 412, 414 cast-in in accordance with the invention.

Figure 6:
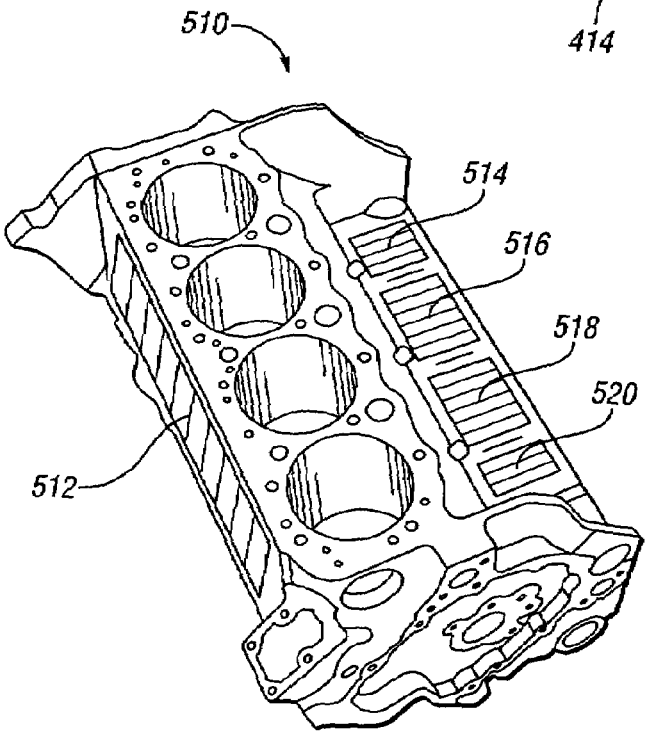
FIG. 6 shows a schematic perspective view of an engine block having cast inserts in accordance with the invention.

FIG. 6 shows a schematic perspective view of an engine block 510 having casting inserts 512, 514, 516, 518, 520 in accordance with the invention.

Figure 7:
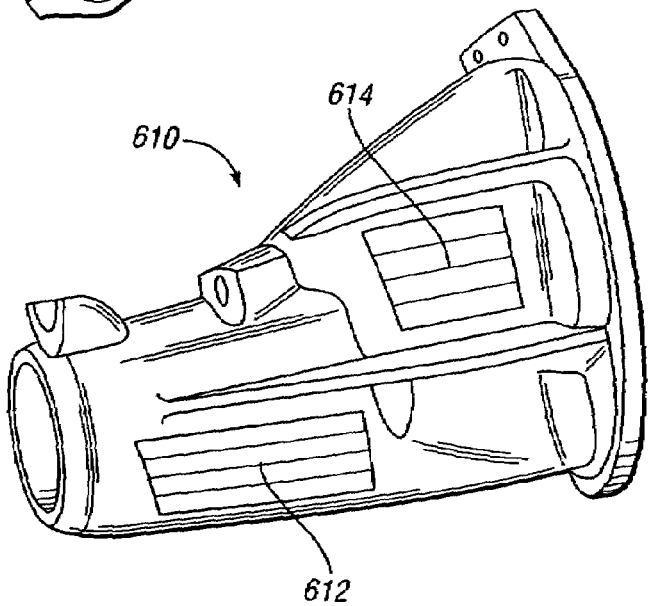
FIG. 7 shows a schematic perspective view of a rear end housing having cast inserts in accordance with the invention.

FIG. 7*b* shows a schematic perspective view of a rear end housing 610 having casting inserts 612, 614 in accordance with the invention.

The locating tabs are not shown in the various views, but can be used on the ID, OD or both positions to stabilize the insert during the metal casting operation. The number and placement of tabs depends on the specific part geometry and its dimensions, and on the thickness of the insert. The wall within which the casting is inserted may be locally thickened to accommodate the insert.

The inserts are preferably 1.5 to 2 mm in thickness, but other thicknesses may be used. The thicknesses are chosen to prevent bending of the insert while not being so thick as to "chill" the surrounding casting to the point that objectionable carbides are produced.

By preventing the insert from reacting with the liquid alloy (i.e. casting material) during casting, the interfaces are maintained for desired sound damping. By enhancing the bond between the tabs and the cast steel, the gap at the tab areas is eliminated in order to isolate the interfaces from the casting exterior environment to eliminate corrosion issues in service.

As a further alternative embodiment, the above-described coated inserts may be provided in a structural oil pan.

To those skilled in the art to which this invention pertains, the above described preferred embodiments may be subject to change or modification. Such change or modification can be carried out without departing from the scope of the invention, which is intended to be limited only by the scope of the appended claims.

The invention claimed is:

1. A method for manufacturing an enclosure member, comprising the steps of: (A) positioning at least one insert into a mold, wherein the insert is provided with a coating to prevent bonding between the insert and the casting material; and (B) casting a wall of the enclosure member in the mold around the insert such that a major portion of the insert is substantially non-bonded with the casting material to provide a proper interfacial boundary with the casting material for damping.

2. The method of claim 1, wherein said enclosure member comprises an electric motor drive housing.

3. The method of claim 1 wherein said enclosure member comprises a transmission housing.

4. The method of claim 1, wherein said enclosure member comprises a rear end housing.

5. The method of claim 1, wherein said enclosure member comprises an engine block.

6. The method of claim 1, wherein said enclosure member comprises a differential case.

7. The method of claim 1, wherein said enclosure member comprises an exhaust manifold.

8. The method of claim 1, wherein said enclosure member comprises a cylinder head.

9. A method of reducing objectionable noise in a vehicle comprising:

casting at least one insert into a wall of a powertrain enclosure member which at least partially houses noise-generating rotating components of the powertrain; and wherein said insert is at least partially pre-coated to prevent bonding of a major portion of the insert with the wall to provide a proper interfacial boundary between the insert and the wall for damping noise.

10. A method for manufacturing an enclosure member, comprising the steps of: (A) positioning at least one insert into a mold, wherein the insert is provided with a coating to substantially prevent bonding between the insert and the casting material; and (B) casting a wall of the enclosure member in the mold around the insert such that a major portion of the insert is substantially non-bonded with the casting material to provide a proper interfacial boundary with the casting material for damping, wherein said at least one insert is provided with peripheral tabs to support the insert in a suspended position within the mold for said casting.

* * * * *